US008756718B2

(12) United States Patent
Tymofy

(10) Patent No.: US 8,756,718 B2
(45) Date of Patent: Jun. 24, 2014

(54) UNDERGARMENT FOR USE WITH PROTECTIVE VEST

(76) Inventor: Craig Tymofy, Syracuse, NY (US)

( * ) Notice: Subject to any disclaimer, the term of this patent is extended or adjusted under 35 U.S.C. 154(b) by 71 days.

(21) Appl. No.: 13/410,345

(22) Filed: Mar. 2, 2012

(65) Prior Publication Data

US 2012/0233749 A1 Sep. 20, 2012

Related U.S. Application Data

(60) Provisional application No. 61/453,749, filed on Mar. 17, 2011.

(51) Int. Cl.

| | |
|---|---|
| ***A41C 1/14*** | (2006.01) |
| ***A41B 9/06*** | (2006.01) |
| ***A41D 27/00*** | (2006.01) |
| ***A41D 27/06*** | (2006.01) |
| ***A41D 13/00*** | (2006.01) |

(52) U.S. Cl.
USPC ..... 2/256; 2/113; 2/463

(58) Field of Classification Search
USPC ..... 2/456, 46, 69, 77, 112, 113, 269, 97, 2/243.1, 255, 256, 272, DIG. 1
See application file for complete search history.

(56) References Cited

U.S. PATENT DOCUMENTS

| | | | | |
|---|---|---|---|---|
| 4,451,934 | A | 6/1984 | Gioello | |
| 5,001,783 | A * | 3/1991 | Grilliot et al. | 2/81 |
| 5,146,625 | A | 9/1992 | Steele et al. | |
| 5,274,849 | A * | 1/1994 | Grilliot et al. | 2/81 |
| 5,515,543 | A | 5/1996 | Gioello | |
| 6,128,784 | A * | 10/2000 | Frank | 2/102 |
| 6,260,201 | B1 * | 7/2001 | Rankin | 2/69 |
| 6,874,332 | B2 | 4/2005 | Forgach | |
| 7,043,766 | B1 * | 5/2006 | Foreman et al. | 2/81 |
| 7,546,853 | B2 * | 6/2009 | Rock et al. | 139/391 |
| 7,636,948 | B1 | 12/2009 | Crye et al. | |
| 8,327,462 | B2 * | 12/2012 | Feldman et al. | 2/2.5 |
| 2005/0246826 | A1 | 11/2005 | McCarter et al. | |
| 2008/0289078 | A1 * | 11/2008 | Mather | 2/85 |

* cited by examiner

*Primary Examiner* — Alissa L Hoey
*Assistant Examiner* — Jameson Collier
(74) *Attorney, Agent, or Firm* — Bernhard P. Molldrem, Jr.

(57) ABSTRACT

An undergarment to be worn beneath a protective vest or uniform permits escape of perspiration and heat, and ventilation so that the wearer can remain reasonably comfortable while wearing the vest. The undergarment has vertically elongated ribs or bars space the vest away from the torso to create ventilation channels. Heat and perspiration vapor escape at the neck of the vest. The ribs or bars can each comprise a cloth strip or pocket sewn onto the garment, to contain a lightweight rod of open-cell or closed-cell polyethylene foam. Three or more of these ribs can be sewn onto the front, and two or more sewn onto the back.

14 Claims, 1 Drawing Sheet

UNDERGARMENT FOR USE WITH PROTECTIVE VEST

Priority is claimed of provisional Appln. Ser. No. 61/453,749, filed Mar. 17, 2011.

BACKGROUND OF THE INVENTION

The present invention relates to an undergarment to be worn beneath a protective vest, e.g., a bulletproof vest made of Kevlar® or similar material designed to stop bullets shot from a pistol from penetrating and injuring the police officer. These protective vests can be heavy and do not permit much perspiration vapor to escape, and thus can result in overheat, discomfort, and heavy perspiration if worn by the officer for an extended period of time. To date, attempts to overcome the problem of heat and perspiration have involved mechanical blowers to create ventilation beneath the vest. These items have been clumsy and uncomfortable to wear, and require frequent battery changes. There is also a need to ventilate the top or blouse of a uniform, as well as a protective vest.

OBJECTS AND SUMMARY OF THE INVENTION

An objective is to provide the officer with a simple, straightforward solution that channels the body heat and vapor away from the officer's torso and out the protective vest by convection, so that no mechanical mechanisms or moving parts are required, and which overcome drawbacks of the prior art.

It is a more specific object to provide an undergarment, e.g., a T-shirt or the like, for the officer to wear beneath the protective vest that creates spaces to permit the escape of perspiration and heat, and to allow sufficient ventilation so that the officer can remain reasonably comfortable while wearing the vest.

According to an aspect of the invention, an undergarment that is worn beneath the protective vest, which in one illustrative example is a tee shirt, and is provided with vertical spacer ribs to create the needed ventilation spaces beneath the protective vest. The tee shirt can be made of a woven or knit cloth, typically a jersey material, which can be cotton, cotton blend, or synthetic fiber. Vertically elongated ribs or bars space the vest away from the officer's torso to create vertical open ventilation channels, so that heat and perspiration vapor can escape at the neck of the vest. The ribs or bars can each comprise a cloth strip or pocket sewn (or otherwise adhered) onto the tee shirt, either on the inner or outer side, preferably on the outer side, and with the strip or pocket containing a lightweight, flexible foam member, e.g., a cylindrical rod of open-cell or closed-cell polyethylene foam or a similar material suited to create the needed spacing. In a favorable embodiment, there are three of these ribs sewn onto the front, i.e., at right, center, and left, and two sewn onto the back, i.e., at the right and left. These extend up to or near the neck of the undergarment, except for the center front rib where the upper end is about four inches below the neck of the undergarment so as not to restrict the officer's head movement. The lower ends can be several inches above the bottom hem of the undergarment. These are more or less aligned with the collar bone and the shoulder blades.

The undergarment permits cooling and ventilation through natural convection, so that no fan or blower is needed, and there are no moving parts to fail or run down. As an additional benefit, the space created between the officer's torso and the vest helps spread out any trauma in the event of a bullet strike against the vest. That is, the blow or concussion from a bullet strike against the protective vest is spread over a larger area of the officer's torso, which reduces trauma injury and pain when the vest stops a bullet.

The material can include silk or part silk to effect wicking of moisture away from the torso. The material may alternatively include cotton or a natural/synthetic blend that has the desired wicking and cooling effect. Dark, subdued colors are preferred, e.g., a charcoal, gray, black or subdued green, so as avoid creating a triangular target area at the throat of the wearer, where the neck portion of the undergarment is exposed. More preferably, the undergarment may be of a color that matches the color of the protective vest or uniform.

DETAILED DESCRIPTION

The undergarment 10 is shown here in the form of a men's tee shirt with a body or torso portion 12 that extends from a lower hem near the waist of the officer up to a neck opening at the officer's neck. This can be of any standard or improved material, depending on the preferences and requirements of the police officer wearing the undergarment. Preferably, the undergarment is made of a cloth that has good wicking properties to permit moisture and heat from the officer's torso to escape through.

Figure 1:
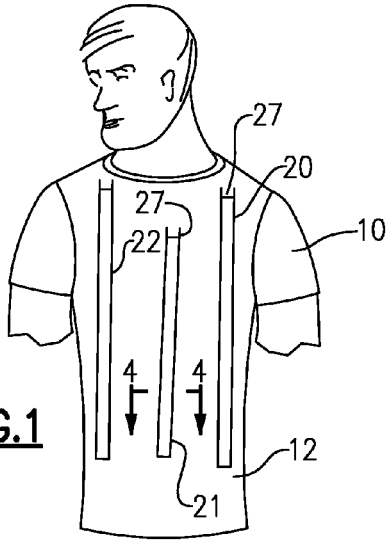
FIG. 1 is a front view of an officer wearing an undergarment that embodies the concepts and ideas of this invention. The protective vest itself is not shown.
Figure 2:
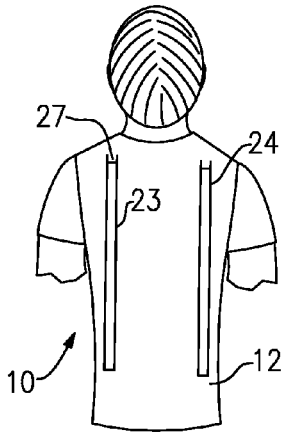
FIGS. 2 and 3 are a rear view and a left-side view thereof.
Figure 3:
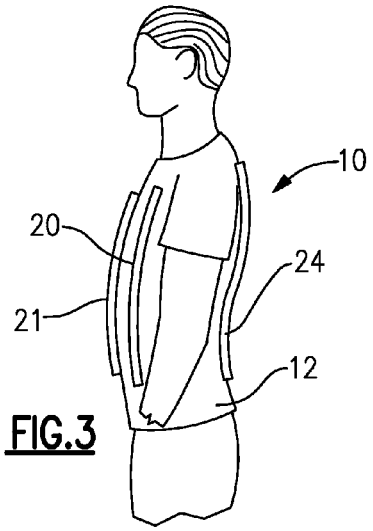

FIGS. 1 to 3 show the garment with vertical elongated ribs or spacers, including, at the front (FIG. 1) one rib 20 at the left, one rib 21 at the center, and one rib 22 at the right, and at the back (FIG. 3) one rib 23 at the left and one rib 24 at the right. As shown, the ribs 20 and 22 extend up to the neck opening of the garment, while the rib 21 ends about four inches below the neck opening. There is no center rib on the back of the garment in this embodiment, but in other embodiments one or more ribs could be present at or along the spine region, e.g., a pair of ribs along either side of the spine. The front side ribs 20 and 22 can preferably be positioned so as to align with the left and right collarbone processes between the neck and shoulder, and the back side ribs 23 and 24 can be positioned to align with the wearer's shoulder blades.

Figure 4:
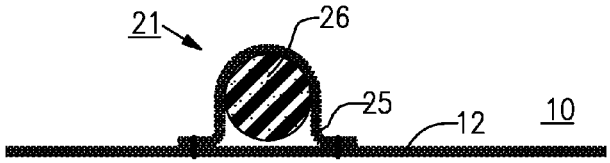
FIG. 4 is a section view, taken at 4-4 of FIG. 1, showing details of construction of the foam rib member and pocket for it that is sewn onto the undergarment.

As shown in FIG. 4, each of the ribs can be comprised of a cloth pocket or strip 25, sewn onto the body of the garment on the inside or on the outside, i.e., the side towards the protective vest. These may be of a jersey material, or formed of a woven cloth material cut along the bias. These pockets 25 are elongated vertically and dimensioned to accommodate a respective foam member 26. In this case, the foam member 26 is a rod of a flexible, resilient closed-cell polyethylene foam, of circular profile, and with a diameter of about five-eighths inch. In this embodiment each rib foam member is a single elongated member, but in other constructions, these can be in sections, to facilitate folding of the garment. These polyfoam rib members 26 provide sufficient spacing for adequate ventilation, without causing discomfort or hindering the officer's movements. The foam is strong enough to avoid crushing under the vest, but soft enough to provide cushioning.

The pockets can be provided with an access slot 27 near the top, if desired, to permit the foam members to be inserted or removed and replaced.

As shown here in FIG. 4, the cloth strip or pocket can be sewn directly to the fabric of the torso portion 12 of the garment 10. In other alternative arrangements, the pockets or strips may be bonded with adhesive.

The undergarment can be laundered normally and machine-dried, without damage to the foam materials in the ribs. Also, while a standard tee is shown here to embody the undergarment, it is possible to carry out the principles and concepts of the invention on a different undergarment, e.g., a sleeveless shirt or a long-sleeved shirt.

Figure 5:
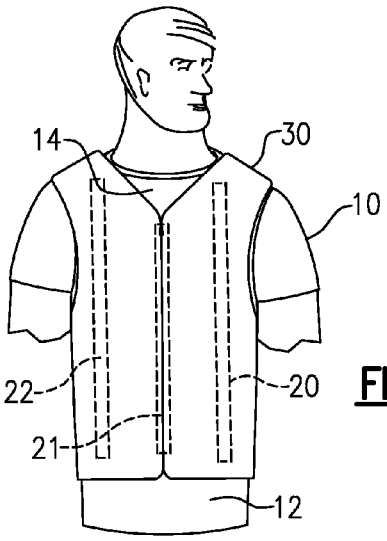
FIG. 5 illustrates the wearing of the vest with the undergarment therebeneath.

FIG. 5 illustrates the undergarment 10 being worn beneath a protective vest 30. The elongated vertical ribs 20, 21 and 22 are shown here in broken line, as being beneath the front part of the vest 30. The waist of the vest 30 is near the lower ends of the ribs to a few inches below the lower ends of the ribs. In this case, the vest 30 had a V-neck at the wearer's throat area so as not to restrict head movement. Here it can be seen that a neck portion 14 of the garment may be exposed to sight. Accordingly, the undergarment is selected to have a dark or subdued color, so that the neck portion 14 does not present a highly visible target to a hostile shooter. More preferably, the undergarment may be colored so as to match as closely as possible the color the vest 30 or uniform top.

As can now be understood, the ribs 20, 21, 22 and 23, 24 space the vest 30 away from the officer's chest and back, and thus create open channels between the ribs so that heat and water vapor can escape, by convection, out the neck opening of the vest. The undergarment 10 when worn in combination with the protective vest permits the officer to remain on station for extended periods without undue discomfort or risk of dehydration or overheating.

As also mentioned, the undergarment with the foam ribs also serves to diffuse the impact trauma from a bullet in the event that the vest 30 actually stops a bullet shot at the officer, thus reducing pain and trauma injury.

The invention is not limited to the details as shown in described in the illustrative embodiment. Rather the scope and spirit of this invention can be determined from the appended claims.

I claim:

1. Undergarment to be worn on the torso of a wearer beneath a protective vest or protective uniform, the undergarment consisting of: a fabric tee shirt having a front and back and extending from a lower hem up to a neck opening; and left, central and right elongated flexible vertical rib members, the rib members extending vertically from above the lower hem towards said neck opening and configured to create vertical open channels between the undergarment and the protective vest or uniform to allow body heat and moisture to escape out at a neck opening of the vest or uniform, wherein each said rib member is in the form of a closed-cell polyethylene foam rod of generally circular profile and a diameter of substantially five-eighths inch; and wherein the central rib member is adapted to align with the sternum of said wearer, and wherein the left and right rib members are positioned such that when the undergarment is worn the left and right rib members are disposed at respective positions between the wearer's neck and shoulders, such that the rib members define left and right open vent spaces between the central rib member and the respective left and right rib members.

2. The undergarment of claim 1 wherein each of said rib members is removably contained in a respective elongated fabric pocket sewn onto the front of the fabric tee shirt.

3. The undergarment of claim 2 wherein each said elongated fabric pocket is a fabric member that is affixed onto the undergarment and sewn on left and right edges thereof to the tee shirt.

4. The undergarment of claim 1 wherein said central rib member has an upper end adapted to be positioned several inches below said neck opening of said protective vest or protective uniform.

5. The undergarment of claim 1 wherein said fabric tee shirt is formed of a fabric of a dark subdued color.

6. The undergarment of claim 1 wherein said fabric tee shirt is made of a fabric having wicking properties to wick moisture away from the wearer's torso.

7. Undergarment to be worn on the torso of a wearer beneath a protective vest or protective uniform, the undergarment consisting of:

a fabric tee shirt having a front and back and extending from a lower hem up to a neck opening;

left, central and right elongated flexible vertical rib members, the rib members extending vertically from above the lower hem towards said neck opening and configured to create vertical open channels between the undergarment and the protective vest or uniform to allow body heat and moisture to escape out at a neck opening of the vest or uniform, wherein each said rib member is in the form of a closed-cell polyethylene foam rod of generally circular profile and a diameter of substantially five-eighths inch; and wherein the central rib member is adapted to align with the sternum of said wearer, and wherein the left and right rib members are positioned such that when the undergarment is worn the left and right rib members are disposed at respective positions between the wearer's neck and shoulders, such that the rib members define left and right open vent spaces between the central rib member and the respective left and right rib members; and a left back vertical rib member and a right back vertical rib member disposed on the back of said fabric tee shirt at spaced locations on the back of the tee shirt and the left back vertical rib member and the right back vertical rib member being adapted to define therebetween an open vent area centered on the wearer's backbone.

8. The undergarment of claim 7 wherein said left and right back vertical rib members are positioned on the back of the undergarment so that when worn the left and right back vertical rib members align with respective shoulder blades of the wearer.

9. In combination, a protective vest or uniform that is configured to be worn on the torso of a wearer and having a waist portion at a lower end of said protective vest or uniform, a neck opening for the wearer's neck, and openings for the wearer's arms; and an undergarment to be worn on the torso of the wearer beneath the protective vest or uniform, the undergarment consisting of:

a fabric tee shirt having a front and back and extending from a lower hem up to a neck opening thereof;

a left elongated rib member, a right elongated rib member, and a center elongated flexible rib member, each of said rib members being formed of an elongated rod of a polyethylene foam of circular profile and with a diameter of substantially five-eighths inch and extending vertically from above the lower hem towards said neck opening of said undergarment and creating vertical open channels between the fabric tee shirt and the protective vest or uniform to allow body heat and moisture to escape out at the neck opening of the protective vest or uniform, and wherein said central rib member is adapted to align with the sternum of said wearer, and said left and right rib members are each positioned so that when the undergarment is worn the left and right ribs are disposed at respective positions between the wearer's neck and shoulders, such that the rib members define left and right open vent spaces between the central rib member and the respective left and right rib members.

10. The combination of claim 9 wherein each of said rib members is removably contained in an elongated fabric pocket.

11. The combination of claim 10 wherein each said elongated fabric pocket is a fabric member that is affixed onto the front of the fabric tee shirt, and sewn on left and right edges thereof to the tee shirt.

12. The combination of claim 9, wherein the central rib member has an upper end several inches below said neck opening of said undergarment.

13. In combination, a protective vest or uniform that is configured to be worn on the torso of a wearer and having a waist portion at a lower end of said protective vest or uniform, a neck opening for the wearer's neck, and openings for the wearer's arms; and an undergarment to be worn on the torso of the wearer beneath the protective vest or uniform, the undergarment consisting of:

a fabric tee shirt having a front and back and extending from a lower hem up to a neck opening thereof;

a left front elongated rib member, a right front elongated rib member, and a center elongated flexible rib member, each of said rib members being formed of an elongated rod of a polyethylene foam of circular profile and with a diameter of substantially five-eighths inch and extending vertically from above the lower hem towards said neck opening of said undergarment and creating vertical open channels between the fabric tee shirt and the protective vest or uniform to allow body heat and moisture to escape out at the neck opening of the protective vest or uniform, and wherein said central rib member is adapted to align with the sternum of said wearer, and said left and right front rib members are each positioned so that when the undergarment is worn the left and right front rib members are disposed at respective positions between the wearer's neck and shoulders, such that the rib members define left and right open vent spaces between the central rib member and the respective left and right front rib members; and a left back vertical rib member and a right back vertical rib member at spaced locations on the back of the tee shirt and adapted to define therebetween an open vent area centered on the wearer's backbone.

14. The combination of claim 13, wherein said fabric tee shirt is formed of a fabric of a subdued color corresponding to that of the protective vest or uniform.

* * * * *